US012600913B2

(12) United States Patent
Roe

(10) Patent No.: US 12,600,913 B2
(45) Date of Patent: Apr. 14, 2026

(54) LIQUID BASED CHEMICAL COMPOSITIONS AND TREATMENT SYSTEMS AND TREATMENT METHODS USING SAME FOR REDUCING SULFUR CONTENT IN HYDROCARBON BASED LIQUIDS INCLUDING CRUDE OIL

(71) Applicant: GAPS TECHNOLOGY, LLC, Slidell, LA (US)

(72) Inventor: Cliffton Lee Roe, Harrison Township, MI (US)

(73) Assignee: Gaps Technology, LLC, Slidell, LA (US)

( * ) Notice: Subject to any disclaimer, the term of this patent is extended or adjusted under 35 U.S.C. 154(b) by 157 days.

(21) Appl. No.: 18/515,969

(22) Filed: Nov. 21, 2023

(65) Prior Publication Data

US 2024/0166955 A1 May 23, 2024

Related U.S. Application Data

(60) Provisional application No. 63/427,153, filed on Nov. 22, 2022.

(51) Int. Cl.
*C10G 19/02* (2006.01)

(52) U.S. Cl.
CPC ..... *C10G 19/02* (2013.01); *C10G 2300/202* (2013.01)

(58) Field of Classification Search
CPC ..... H01L 21/28587; H01L 21/32136; H10D 30/0612; H10D 30/6738; H10D 30/675; H10D 62/85; H10D 64/411; H10D 64/64; Y10S 148/10; C10G 19/02; C10G 2300/202
See application file for complete search history.

(56) References Cited

U.S. PATENT DOCUMENTS

| | | | | |
|---|---|---|---|---|
| 10,913,911 | B1 | 2/2021 | Roe | |
| 12,492,349 | B2 | 12/2025 | Roe et al. | |
| 2019/0153332 | A1* | 5/2019 | Roe | C02F 1/50 |

FOREIGN PATENT DOCUMENTS

| | | | |
|---|---|---|---|
| WO | 2019/036731 | A2 | 2/2019 |
| WO | 2019/209379 | A1 | 10/2019 |
| WO | 2022/236110 | A1 | 11/2022 |
| WO | 2022/236186 | A1 | 11/2022 |

* cited by examiner

*Primary Examiner* — Ellen M McAvoy
*Assistant Examiner* — Chantel Graham
(74) *Attorney, Agent, or Firm* — Carrier, Shende & Associates P.C.; Joseph P. Carrier; Fulchand P. Shende

(57) ABSTRACT

A treatment composition for being added to petroleum based liquids for reducing total sulfur content in the petroleum based liquids, comprising: sodium sulfide and at least one hydroxide compound. A dosage of the treatment composition may be added to liquids containing sulfur, including crude oil and distillates of crude oil and then allowed to react with such liquids over a period of time, e.g., hours or days. By such reaction total sulfur content of the liquids may be reduced by more than 50%.

8 Claims, No Drawings

LIQUID BASED CHEMICAL COMPOSITIONS AND TREATMENT SYSTEMS AND TREATMENT METHODS USING SAME FOR REDUCING SULFUR CONTENT IN HYDROCARBON BASED LIQUIDS INCLUDING CRUDE OIL

CROSS-REFERENCE TO RELATED APPLICATIONS

This application claims priority to U.S. Provisional Application Ser. No. 63/427,153, filed Nov. 22, 2022. The entire subject matter of this priority application is incorporated by reference herein.

BACKGROUND OF THE INVENTION

1. Field of the Invention

The present disclosure relates to novel liquid treatment compositions and treatment systems and methods using the liquid treatment compositions for reducing sulfur content in hydrocarbon based liquids including crude oil, liquids obtained by refining crude oil and light end hydrocarbon liquids, which may be used as solvents and thinners. More particularly, the present disclosure relates to such treatment systems and methods in which relatively small dosages of the novel liquid treatment compositions are added to the sulfur containing liquids such as crude oil so that the treatment compositions will chemically react with the liquids to expose many of the different sulfur containing species and/or compounds contained in the liquids so that the exposed sulfur containing species/compounds can be remediated and/or removed from the sulfur containing liquids in a practical, efficient and economical manner, while otherwise preventing generation and release of noxious and toxic sulfur containing compounds including $H_2S$ and $SO_2$ from the treated liquids during the treatment process. The sulfur may be removed directly from the treated liquids in the treatment process as precipitates, including elemental sulfur, and/or may be subsequently removed from the treated liquids when the treated liquids are further processed, such as crude oil being refined in a refinery.

2. Background

Sulfur-containing compounds including hydrogen sulfide ($H_2S$) have long been recognized as undesirable contaminants in hydrocarbon fluids including crude oil, natural gas and liquefied petroleum gas (LPG), as well as in aqueous solutions such as contaminated water extracted from the earth along with crude oil and in natural gas. $H_2S$ is generally in gaseous or vapor form at standard temperature and pressure (STP) and is a particularly undesirable contaminant because even in relatively low amounts it can be highly toxic to humans and other animals, corrosive to metals, etc. Generally, hydrocarbon fluids should contain less than four ppm $H_2S$ to be considered safe for commercial purposes. Remediation of $H_2S$ in hydrocarbon fluids has long been and remains a very important focus of petroleum industries around the world.

Apart from concerns about highly toxic $H_2S$, there is also a great desire to reduce total sulfur content in hydrocarbon based liquids including crude oil, light end hydrocarbon liquids, as well as fuels and other liquids obtained from refined crude oil, because when these liquids are handled and combusted the sulfur and sulfur compounds therein can create significant problems. For example, when the liquids are handled the sulfur and sulfur containing compounds therein can be deposited on, build up on and clog surfaces which they contact such as turbine blades, fuel injectors, etc. When these liquids are combusted they release a great deal of sulfur containing compounds including $H_2S$ and $SO_2$ into the atmosphere, that are bad for the environment, humans and other living things. Further, when sulfur melts and decomposes at elevated temperatures it will typically generate $H_2S$ and $SO_2$.

There are many known treatment compositions and treatment processes for remediating $H_2S$ in fluids such as crude oil, including treatment compositions and treatment processes previously proposed by the present inventor, including those disclosed in International Patent Application Nos. PCT/US2018/050913, PCT/US2018/064015, PCT/US2022/028155 and PCT/US2022/028379 and in U.S. Pat. No. 10,913,911 B2. The entire contents of these prior disclosures are incorporated herein by reference. Some of these known processes can result in a substantial reduction of the sulfur content of the liquids being treated. For example, the inventor's previously proposed treatment composition as disclosed in PCT/US2018/050913 is an aqueous based treatment composition containing a relatively high content of one or more hydroxide compounds, e.g., sodium hydroxide (NaOH) and potassium hydroxide (KOH), collectively in a range of 35-55 wt %, and as discussed in PCT/US2018/050913 if a high dosage of the treatment composition, e.g., ≥10 ml is added per liter of contaminated crude oil, the treatment composition will quickly remediate essentially all of the $H_2S$ to other non-toxic, sulfur containing substances and may also cause the remediated $H_2S$ and other contaminants to be released from the treated crude oil as precipitates, whereby total sulfur content of the treated crude oil is reduced.

However, it is not always desirable to remove the remediated $H_2S$ and other contaminants to be released from the treated crude oil as precipitates because the precipitates can cause blockages in treatment systems in which the crude oil is treated and in pipelines through which the treated oil flows leading to undesirable shut downs of the treatment processes and systems. The inventor's previously proposed treatment compositions as disclosed in PCT/US2018/064015 also quickly remediates $H_2S$ in crude oil, but it includes other component(s) which greatly limit or prevent any precipitates from being released from the treated crude oil, e.g., the present inventor has discovered that addition of small amounts of organic acids such as humic acid and fulvic acid in the treatment compositions can be effective at preventing formation and release of precipitates. Crude oil which has been treated with the treatment compositions as disclosed in PCT/US2018/064015 must still be processed in a refinery or the like, which may result in removal of some of the sulfur from the refined crude oil. Generally, only a relatively small amount of the total sulfur content of crude oil is removed in the conventional refinery process, whereas most of the sulfur remains in all of the different fractions or cuts of different liquids obtained in the conventional refinery process of crude oil. Even though conventional refining processes significantly heat the crude oil us to approximately 602° F./316° C. so that it vaporizes and can be separated into many different liquids with different molecular weights, at such temperature the different sulfur containing species and/or compounds in the crude oil may decompose into $H_2S$ and $SO_2$ which remain in the vaporized crude oil even as different cuts of the vaporized crude oil are separated based on their different molecular weights and vaporization temperatures. Thus, the conventional refinery process is not particularly effective for reducing the total sulfur content of the crude oil in the refined products derived from the crude oil.

PCT/US2022/028155 and PCT/US2022/028379 disclose treatment compositions in the form of liquid solutions which include many of the same chemical reactants as the treatment compositions disclosed in PCT/US2018/050913 and PCT/US2018/064015, but which further include organic liquids instead of or in addition to water as the base liquid into which the chemical reactants are dissolved or dispersed for preparing the treatment compositions. The organic liquids used in these treatment compositions typically have much higher vapor pressures than water and can lead to more effective and/or more efficient remediation of some of the contaminants in the contaminated liquids and gasses which may be treated using the compositions, including crude oil.

A significant complicating factor in the removal of sulfur from crude oil is that there are hundreds of different sulfur containing compounds and species, some organic and some inorganic, which may be contained in the crude oil and characteristics of many of the different sulfur containing compounds and species are not well understood. The present inventor has discovered that is not possible to remediate or remove many of these different sulfur containing compounds or species using conventional treatment compositions and treatment processes, including those he has proposed, because in the complex chemical make-up of crude oil many of the sulfur containing compounds and species may be blocked or prevented from reacting with the conventional treatment compositions by other components of the crude oil. For example, even if a high dosage of the inventor's previously proposed treatment compositions disclosed in PCT/US2018/050913 were to be added to a given contaminated crude oil only some of the sulfur containing compounds, including $H_2S$, will be exposed, will react with the treatment compositions and will precipitate out of the treated crude oil, whereas many of the sulfur containing compounds that are blocked or shielded within the make-up of the crude oil will not react with the treatment compositions and will remain in the treated crude oil.

While the present inventor's previously proposed treatment compositions and treatment processes using the treatment compositions have proven to be far more efficient and effective at remediating $H_2S$ and other contaminants in various liquids and gasses, e.g., crude oil and natural gas, in comparison to other treatment compositions and treatment processes conventionally known prior to the inventor's proposals, there is still great demand in the art for treatment compositions and treatment processes that can significantly reduce total sulfur content in crude oil, as well as in fuels and other liquids obtained from refined crude oil, in a controlled, predictable manner and which are also efficient and cost effective.

SUMMARY OF THE INVENTION

An object of the present invention is to satisfy the discussed demand.

The present inventor has carefully investigated this, and has discovered new treatment compositions and treatment processes which are very effective, efficient and economically practical for significantly reducing total sulfur content in crude oil, as well as fuels and other liquids obtained from refined crude oil, in a controlled, predictable manner and which are also efficient and cost effective. One particular focus of the inventor's investigation pertains to reasons why some of the sulfur containing species and compounds are prevented from reacting with the conventional treatment compositions. While the inventor may not fully understand all of the reasons why some of the species and compounds are prevented from reacting with the conventional treatment compositions, he believes that one important reason is that the sulfur in the different sulfur containing compounds and species have different electron arrangements and/or electron valence structures, and that the particular electron arrangement and/or electron valence structure of any given sulfur containing specie or compound will greatly affect their reactivity. Also, the inventor has discovered that many of the sulfur containing compounds and species are polar while others are non-polar, and the polarity has a bearing on which other elements and/or compounds that the sulfur may be bound to in the different sulfur containing compounds and species, e.g., elemental sulfur appears to ionically bond to metals, e.g., copper, whereas some sulfur containing compounds and species appear to covalently bond to organic matter and compounds. Further, the inventor has discovered that whether the contaminated liquid being treated is polar or non-polar may affect how and to what extent the contaminated liquid reacts with the various treatment compositions, e.g., butane is non-polar, while naptha and kerosene are polar.

One important discovery made by the present inventor through his investigation is that sodium sulfide ($Na_2S$ or $HNa_2S^+$) is surprisingly very helpful for reducing total sulfur content in crude oil, as well as in fuels and other liquids obtained from refined crude oil. The inventor has discovered that if sodium sulfide is added to a liquid treatment composition containing one or more hydroxide compound(s), such composition can be very effective for remediating/removing sulfur based compounds and species in liquids such as crude oil and liquids derived from crude oil. The treatment composition containing sodium sulfide and hydroxide compound(s) is surprisingly very effective at exposing and reacting with many of the different sulfur containing compounds or species contained in the crude oil and liquids derived from crude oil which are normally blocked or shielded by other components of these liquids, so that such sulfur containing compounds or species may be remediated and/or removed from the treated liquids using such liquid treatment composition according to the present invention. The inventor has determined that in the combination an appropriate dosage amount of the sodium sulfide is in a range of 0.01 to 5.0 grams of sodium sulfide per liter of crude oil, and that an appropriate collective dosage amount of the hydroxide compound(s) is in a range of 0.005 to 5.0 g per liter of crude oil. In experiments which the inventor has conducted applying liquid treatment compositions containing sodium sulfide and hydroxide compound(s) to various contaminated petroleum based liquids, when the dosage amounts are in the discussed ranges the inventor has found that the total amounts of sulfur in the treated liquids may be ultimately reduced by 50 to 65 weight %.

Another discovery made by the present inventor is that a liquid treatment composition including sodium sulfide and hydroxide compound(s) dissolved or dispersed in solvent(s) such as discussed above may be formulated such that the treatment composition will cause the exposed and remediated sulfur compounds in the crude oil to precipitate out of the treated crude oil before it is refined, or alternately formulated such that the treatment composition will not cause the exposed and remediated sulfur compounds in the crude oil to precipitate out of the treated crude oil before it is refined. It may be desirable in some situations to have the remediated sulfur compounds precipitate out of the treated crude oil for directly reducing the sulfur content of the crude oil, and it may be desirable in other situations to limit or prevent the remediated sulfur compounds from precipitating out of the treated crude oil.

In PCT/US2018/064015 the present inventor has previously proposed addition of small amounts of organic acids such as fulvic acid and humic acid in the treatment composition as an effective manner of preventing release of precipitates from the treated crude oil, and such organic acids may be similarly used in the liquid treatment compositions according to the present invention. However, the inventor has discovered that the treatment compositions according to the present invention can be controlled to either cause or prevent release of precipitates depending on which solvent(s) are used for dissolving or dispersing the sodium sulfide and hydroxide compound(s) therein. For example, the inventor has discovered that if relatively light molecular weight, polar organic liquid(s), including alcohols, toluene, hexane, xylene, and others, as well as mixtures of these liquids, are used with little or no water as the solvents for dissolving or dispersing the sodium sulfide and hydroxide compounds therein, then the treatment composition may likely cause sulfur containing precipitates to be released from the treated crude oil, which precipitates can be readily removed from the treated liquids by filtration, centrifugation, etc. A main one of the precipitates which has been released in experiments conducted by the inventor is a black colored elemental sulfur. On the other hand, if significant amounts of both water and light molecular weight hydrocarbon based liquid(s) such as those discussed above are used as the liquid base of the treatment composition for dissolving or dispersing the sodium sulfide and hydroxide compounds therein, then the inventor has discovered little or no precipitates will be released from the treated crude oil using the treatment compositions according to the present invention. It is desirable to avoid release of precipitates if the treatment process is to be operated on a continuous basis. The inventor has discovered that when significant amounts of both water and light molecular weight hydrocarbon based liquid(s) are used, presence of the light molecular weight hydrocarbon based liquid(s) allows the pH of the treatment composition to be increased above what would be possible if only water was used as the solvent and without causing formation and release of precipitates. This is advantageous because a greater amount of hydroxide compound(s) can be dissolved or dispersed into the treatment composition, whereas a sufficient amount of the hydroxide compound(s) is required to efficiently drive the sulfur—reducing reactions in the treatment process.

Intent of Disclosure

Although the following disclosure of exemplary embodiments of the invention offered for public dissemination is detailed to ensure adequacy and aid in understanding of the invention, this is not intended to prejudice that purpose of a patent which is to cover each new inventive concept therein no matter how it may later be disguised by variations in form or additions of further improvements. The claims at the end hereof are the chief aid toward this purpose, as it is these that meet the requirement of pointing out the improvements, combinations and methods in which the inventive concepts are found.

DETAILED DESCRIPTION OF EXEMPLARY EMBODIMENTS OF THE PRESENT INVENTION

A first aspect and embodiment of the present invention is based on an important discovery made by the present inventor through his investigation is that sodium sulfide ($Na_2S$ or $HNa_2S^+$) is surprisingly very helpful for reducing total sulfur content in crude oil, as well as in fuels and other liquids obtained from refined crude oil. The inventor has discovered that if sodium sulfide is added to a liquid treatment composition containing one or more hydroxide compound(s), such composition can be very effective for remediating/removing sulfur based compounds and species in liquids such as crude oil and liquids derived from crude oil. The treatment composition containing sodium sulfide and hydroxide compound(s) is surprisingly very effective at exposing and reacting with many of the different sulfur containing compounds or species contained in the crude oil and liquids derived from crude oil which are normally blocked or shielded by other components of these liquids, so that such sulfur containing compounds or species may be remediated and/or removed from the treated liquids using such liquid treatment composition according to the present invention. The inventor has determined that in the combination an appropriate dosage amount of the sodium sulfide is in a range of 0.01 to 5.0 grams of sodium sulfide per liter of crude oil, and that an appropriate collective dosage amount of the hydroxide compound(s) is in a range of 0.005 to 5.0 g per liter of crude oil. In experiments which the inventor has conducted applying liquid treatment compositions containing sodium sulfide and hydroxide compound(s) to various contaminated petroleum based liquids, when the dosage amounts are in the discussed ranges the inventor has found that the total amounts of sulfur in the treated liquids may be ultimately reduced by 50 to 65 weight %.

While the inventor may not fully understand why the treatment composition containing sodium sulfide and hydroxide compounds is surprisingly effective at reducing total sulfur content in petroleum based liquids, he believes that the hydroxide compounds function to neutralize organic, sulfur containing compounds and to strip an electron from such sulfur compounds, at which point such organic, sulfur containing compounds readily bond to the sodium sulfide, and may ultimately be removed from the treated petroleum based liquids. Also based on experiments he has conducted, the inventor believes that inorganic sulfur containing compounds in the petroleum based liquids are less likely to be effectively remediated and/or removed using the liquid treatment composition of sodium sulfide and hydroxide compound(s), so that these may remain in the treated petroleum based liquids.

Through experimentation the inventor has further determined that simply increasing the dosage amount of sodium sulfide beyond the upper limit of the discussed range may not lead to further reduction in the total amount of sulfur in the contaminated liquids, but that it is important to use a sufficient amount of hydroxide in the combination in order to drive the reactions with sulfur containing compounds and species, and thereby efficiently achieve the maximum amount of sulfur reduction in the crude oil. However, the inventor has discovered that even if the liquid treatment composition contains an excessive amount of either the sodium sulfide or the hydroxide compound(s) is used this for treating the petroleum based liquids, this is unlikely to detrimentally affect the treated liquids or the value of the treated liquids, provided that excess amount(s) are not more than 5 or 10 times appropriate amounts in the discussed ranges. The pH of treatment compositions according to the present invention will typically be at least 12 and may be as high as 14, and it is the hydroxide compound(s) in the mixture which primarily lead to the high pH values.

Still further, the inventor has determined that other sulfides do not appear to provide the same advantageous effects as sodium sulfide. For example, while carbon disulfide $CS_2$ may also be helpful for reducing total sulfur content of petroleum based liquids, carbon disulfide is relatively noxious and/or toxic for humans, so that use of carbon disulfide is disfavored. As another example, if a variation of sodium sulfide is used in the treatment composition, e.g., sodium polysulfide, the inventor has found that the the treatment composition containing sodium polysulfide together with hydroxide compound(s) is not as effective at reducing total sulfur content of petroleum based liquids in comparison to sodium sulfide.

Generally, all hydroxide compounds may be used in the treatment compositions according to the present invention provided they can be dissolved or dispersed directly in the petroleum based liquid being treated or initially dissolved or dispersed in a solvent which may then be mixed into the petroleum based liquids being treated. However, some hydroxide compounds have lower cost and/or greater accessibility, including NaOH and KOH, and if used may make the treatment compositions and treatment processes using the compositions more economically advantageous. For ease of quickly dispersing the chemicals into the petroleum based liquid being treated, it may be desirable for the sodium sulfide and the hydroxide compound(s) to be initially dissolved or dispersed in water or other solvent to form the liquid treatment composition which is then added to the liquids being treated. For example, sodium sulfide and hydroxide compounds may be readily dissolved or dispersed in water, as well as relatively light molecular weight, polar, organic liquid(s), including alcohols, toluene, hexane, xylene, etc., as well as mixtures of these liquids. Each of NaOH and KOH may be dissolved in water at relatively high concentrations such as 35-55 wt %. Similarly, hydrates of NaOH and KOH may be dissolved in water and relatively light molecular weight hydrocarbon based liquid(s), including alcohols, toluene, hexane, xylene, and others, as well as mixtures of these liquids. Once prepared, the liquid treatment compositions containing the sodium sulfide and hydroxide compounds may be readily, uniformly mixed and dispersed into the crude oil or other petroleum based liquids being treated. It is also possible to directly add the sodium sulfide and hydroxide compounds into the crude oil or other petroleum based liquid being treated, but much more effort and time may be required for directly, uniformly dispersing or dissolving the sodium sulfide and hydroxide compounds into the crude oil or other petroleum based liquids.

Another aspect and embodiment of the present invention relates to a further discovery made by the present inventor, i.e., that a liquid treatment composition including sodium sulfide and hydroxide compound(s) dissolved or dispersed in solvent(s) such as discussed above may be formulated such that the treatment composition will cause the exposed and remediated sulfur compounds in the crude oil to precipitate out of the treated crude oil before it is refined, or alternately formulated such that the treatment composition will not cause the exposed and remediated sulfur compounds in the crude oil to precipitate out of the treated crude oil before it is refined. It may be desirable in some situations to have the remediated sulfur compounds precipitate out of the treated crude oil for directly reducing the sulfur content of the crude oil, and it may be desirable in other situations to limit or prevent the remediated sulfur compounds from precipitating out of the treated crude oil.

In PCT/US2018/064015 the present inventor has previously proposed addition of small amounts of organic acids such as fulvic acid and humic acid in the treatment composition as an effective manner of preventing release of precipitates from the treated crude oil, and such organic acids may be similarly used in the liquid treatment compositions according to the present invention. However, the inventor has discovered that the treatment compositions according to the present invention can be controlled to either cause or prevent release of precipitates depending on which solvent(s) are used for dissolving or dispersing the sodium sulfide and hydroxide compound(s) therein. For example, the inventor has discovered that if relatively light molecular weight, polar organic liquid(s), including alcohols, toluene, hexane, xylene, and others, as well as mixtures of these liquids, are used with little or no water as the solvents for dissolving or dispersing the sodium sulfide and hydroxide compounds therein, then the treatment composition may likely cause sulfur containing precipitates to be released from the treated crude oil, which precipitates can be readily removed from the treated liquids by filtration, centrifugation, etc. A main one of the precipitates which has been released in experiments conducted by the inventor is a black colored elemental sulfur. On the other hand, if significant amounts of both water and light molecular weight hydrocarbon based liquid(s) such as those discussed above are used as the liquid base of the treatment composition for dissolving or dispersing the sodium sulfide and hydroxide compounds therein, then the inventor has discovered little or no precipitates will be released from the treated crude oil using the treatment compositions according to the present invention. It is desirable to avoid release of precipitates if the treatment process is to be operated on a continuous basis. The inventor has discovered that when significant amounts of both water and light molecular weight hydrocarbon based liquid(s) are used, presence of the light molecular weight hydrocarbon based liquid(s) allows the pH of the treatment composition to be increased above what would be possible if only water was used as the solvent and without causing formation and release of precipitates. This is advantageous because a greater amount of hydroxide compound(s) can be dissolved or dispersed into the treatment composition, whereas a sufficient amount of the hydroxide compound(s) is required to efficiently drive the sulfur—reducing reactions in the treatment process.

Example 1) Formulation with Little or No Water

An example of a treatment composition according to the present invention which includes little or no water includes the following components, wherein the hydroxide compounds and sodium sulfide are directly dissolved or dispersed in the methanol or other relatively light molecular weight, polar hydrocarbon based liquid(s):

- 1.0 liter of methanol or other relatively light molecular weight, polar hydrocarbon based liquid(s), including alcohols, toluene, hexane, xylene, and mixtures thereof;
- 15-35 g total of hydroxide compound(s), e.g., potassium hydroxide hydrate and/or sodium hydroxide hydrate; and
- 5-50 g of sodium sulfide ($Na_2S$ or $HNa_2S^+$).

The discussed components were mixed together so that the hydroxide compound(s) and sodium sulfide fully dissolved or dispersed into the polar hydrocarbon based liquid(s) and resulted in about 1 liter of treatment composition.

According to aspect and embodiment of the present invention is a treatment process involving the treatment composition according to Formulation of Example 1) for treating contaminated petroleum based liquids including crude oil and liquids obtains by refining crude oil. A specific example of the new treatment process was conducted involving diesel fuel having API rating of about 35. Two ml of the Formulation of Example 1) was added to 1 liter of the diesel fuel and they were mixed together with a stir plate for 30 minutes at standard temperature and pressure (STP), e.g., 20-25° C. and one atmosphere, and then the mixing was discontinued and the mixture was left without further stirring for another 30 minutes. A negligible amount of $SO_2$. e.g., far less than 1 wt % of the mixture, was given off as a gas and about 3 g of a sulfur precipitate, e.g., black elemental sulfur, was released from the treated diesel fuel. Analysis of the diesel fuel before and after the treatment process showed that the of sulfur containing precipitate released from the treated diesel fuel amounted to about 51 wt % of the total sulfur contained in the diesel fuel. The inventor also found that conducting the treatment process at STP is advantageous for achieving a maximum amount of sulfur reduction. If the treatment process is conducted at elevated temperatures, for example, the process may be completed more quickly, but the amount of sulfur reduction may be less.

Example 2) Formulation with Significant Amount of Water

Another exemplary embodiment of a treatment composition according to the present invention which includes a significant amount of water includes the following components, wherein the hydroxide compounds and sodium sulfide are initially dissolved or dispersed in water and then combined with the methanol or other relatively light molecular weight, polar hydrocarbon based liquid(s):

- 100 g of sodium sulfide ($Na_2S$ or $HNa_2S^+$) was dispersed or dissolved into 200 ml of water,
- 200 ml of an aqueous solution of KOH 50 wt %; and
- 800 ml of methanol or other relatively light molecular weight, polar hydrocarbon based liquid(s), including alcohols, toluene, hexane, xylene, and mixtures thereof.

The discussed components were mixed together so that the liquid treatment composition containing hydroxide compound(s) and sodium sulfide were uniformly dispersed into the polar hydrocarbon based liquid(s) and resulted in about 1.2 liter of treatment composition.

A treatment process involving the liquid treatment composition according to Formulation of Example 1) for treating a relatively light crude oil having an API rating having API rating of about 35 was conducted on a continuous basis, 4-5 ml of the Formulation was added per liter of the light crude oil in a continuous treatment process and the combination of fluids was then flowed along a pipeline to a refinery, which took more than one hour such that the treatment composition was uniformly mixed into the light crude oil and reacted with many of the sulfur containing compounds and species. Once at the refinery the light crude oil was refined. Little or no precipitates were released from the treated, light crude oil during the treatment process, including as the treated light crude oil flowed along the pipeline. The light crude oil was separated into several different liquids with different molecular weights by the refining process, and a sludge containing asphaltene that accumulated at the bottom of the refining system was occasionally removed. Analysis of the light crude oil before and the treatment process, as well as analysis of the different refined liquids with different molecular weights, and the asphaltene containing sludge from the refining process showed that the refined liquids with different molecular weights had about 60 wt % less of total sulfur compared to the untreated light crude oil and that most of the sulfur that was removed from the light crude oil instead remained in the asphaltene, primarily as elemental sulfur.

While the inventor may not fully understand why precipitates are not released from the treated crude oil and other petroleum based liquids when both water and light molecular weight hydrocarbon based liquid(s) are used, he believes that one important factor is that there is typically some amount of salts contained in the treated liquids, whereas the salts are readily dissolved in water and may remain in the treated liquids without precipitating because the salts remain dissolved in the water included in the treatment compositions that have been added to the treated liquids. On the other hand, if the treatment compositions contain little or no water, the salts in the treated liquids may tend to precipitate out of the treated liquids and this may cause the remediated sulfur containing compounds in the treated liquids to also precipitate out of the treated liquids.

The foregoing description is given for clearness of understanding only, and no unnecessary limitations should be understood therefrom, as modifications within the scope of the invention may be apparent to those having ordinary skill in the art and are encompassed by the claims appended hereto.

I claim:

1. A treatment composition for being added to petroleum based liquids for reducing total sulfur content in the petroleum based liquids, comprising: sodium sulfide, water and at least one hydroxide compound.

2. The treatment composition according to claim 1, further including at least one polar solvent into which the sodium sulfide, water and the at least one hydroxide compound are dissolved or dispersed.

3. The treatment composition according to claim 2, wherein the sodium sulfide constitutes 3-20 wt % of the composition, the at least one hydroxide compound constitutes 5-25 wt % of the treatment composition, the at least one polar solvent constitutes 55-92 wt % of the treatment composition, and a pH of the treatment composition is at least 12.5.

4. The treatment composition according to claim 2, wherein the at least one polar solvent includes at least one of polar hydrocarbon based liquid(s), including alcohols, toluene, hexane, xylene, and mixtures thereof.

5. A treatment process for reducing total sulfur content in a petroleum based liquid, comprising steps of: dissolving sodium sulfide and at least one hydroxide compound in water to form an aqueous solution; adding the aqueous solution to the petroleum based liquid, wherein a dosage amount of sodium sulfide is 0.01 to 5.0 g per liter of the petroleum based liquid and a total dosage amount of the at least one hydroxide compound is in a range of 0.01 to 5.0 g per liter of the petroleum based liquid; of dispersing the aqueous solution into the petroleum based liquid; and allowing the sodium sulfide and the at least one hydroxide compound to react with the petroleum based liquid.

6. The treatment process according to claim 5, further comprising the step of adding at least one polar solvent to the aqueous solution before the aqueous solution is added into the petroleum based liquid.

7. The treatment process according to claim 6, wherein the at least one polar solvent includes at least one of polar hydrocarbon based liquid(s), including alcohols, toluene, hexane, xylene, and mixtures thereof.

8. The treatment process according to claim 6, wherein the step of allowing the sodium sulfide and the at least one hydroxide compound to react with the petroleum based liquid is performed at standard temperature and pressure.

* * * * *